United States Patent [19]

Stauner

[11] 4,134,432

[45] Jan. 16, 1979

[54] JACQUARD MACHINE

[75] Inventor: Rudolf Stauner, Constance, Germany

[73] Assignee: Sulzer Brothers Limited, Winterthur, Switzerland

[21] Appl. No.: 826,235

[22] Filed: Aug. 19, 1977

[30] Foreign Application Priority Data

Sep. 2, 1976 [CH] Switzerland ..... 11126/76

[51] Int. Cl.[2] ..... D03C 3/16; D03C 3/20

[52] U.S. Cl. ..... 139/59; 139/319; 139/331

[58] Field of Search ..... 139/59–65, 139/317, 319, 331; 66/154 R, 154 A

[56] References Cited

U.S. PATENT DOCUMENTS 748,028 12/1903 Szczepanik ..... 139/331
983,862 2/1911 Regal ..... 139/319
3,472,287 10/1969 Ribler ..... 139/319

FOREIGN PATENT DOCUMENTS 238203 8/1926 United Kingdom ..... 139/319

*Primary Examiner*—James Kee Chi
*Attorney, Agent, or Firm*—Kenyon & Kenyon, Reilly, Carr & Chapin

[57] ABSTRACT

The Jacquard machine employs a selector system for blocking and un-blocking the pressers (e.g. Jacquard needles) wherein use is made of pivotally mounted locking levers between a control element and each presser. The control elements which may be in the form of multimorphous bending strips or a switching means comprised of two electrically magnetizable relatively movable rod-like members, engage with the levers to cause pivoting of the levers into a blocking or non-blocking position relative to the pressers.

16 Claims, 7 Drawing Figures

JACQUARD MACHINE

This invention relates to a Jacquard machine and, more particularly, to a Jacquard selection system.

As is known, various types of Jacquard machines have been used for controlling the warp yarns of a weaving machine. For example, U.S. Pat. Nos. 3,871,415 and 3,828,826 each describe a Jacquard mechanism employing control elements such as multimorphous elements which are movable into blocking and non-blocking positions to control the position of a lifting hook. However, in systems where the bending element experiences heavy stressing when sensed directly by a Jacquard needle or presser, the bending elements tend to break because of the brittleness of the material from which the elements are made. In order to overcome this problem, it has been known to provide a means between a bending element and a presser which can be moved by the bending element into a blocking or non-blocking position relative to the presser while at the same time transferring the force imposed by a presser in the blocking position into a casing or housing. Such a construction is described in U.S. Pat. application Ser. No. 654,784, filed Feb. 3, 1976. In this case, use is generally made of a slider which is disposed in a guideway or a casing in order to be pushed against a wall of the guideway by a presser when moved into the blocking position by a bending element. Generally, the sliders are loosely received within the guideway. Thus, fabrication of these selector mechanisms can become cumbersome particularly when placing and maintaining the individual sliders in the proper place.

Accordingly, it is an object of the invention to provide a Jacquard machine which has an improved selector mechanism.

It is another object of the invention to provide a Jacquard machine in which the force of a presser in a blocked condition is directly transferred to a casing of the selection system.

Briefly, the invention provides a Jacquard selection system for a Jacquard machine having a plurality of pressers for programming a plurality of lifting wires for controlling the warp yarns of a weaving machine and a presser drive at one end of the pressers for moving the pressers in a given direction. The selection system is disposed at an opposite end of the pressers from the drive for selectively inhibiting the movement of the pressers in accordance with a weave program.

The selection system includes a plurality of control elements which are movable between at least two positions and a plurality of means such as locking levers which are disposed for movement into and out of the path of a respective presser in response to movement of a respective control element.

The selection system further includes a casing in which the control elements and the locking levers are mounted. In addition, the control levers are disposed in the casing to transfer the force of a presser into the casing when the presser is in a sensing position without stressing of the control element. Consequently, the sensing forces of the pressers do not have to be taken up by the control elements directly. Instead, these forces act via the locking levers on the casing. The sensing forces can, therefore, be increased without any risk of destroying or damaging the control elements as may be inevitable, for instance, in the case of relatively heavy lifting wires. Also, the locking levers can be so devised so that the associated control element is required to perform very little work to pivot them.

In one embodiment the control element is a multimorphous bending strip while in a second embodiment, the control element is in the form of a switching means comprised of two electrically magnetizable relatively movable rod-like members.

These and other objects and advantages of the invention will become more apparent from the following detailed description and appended claims taken in conjunction with the accompanying drawings in which:

Figure 1:
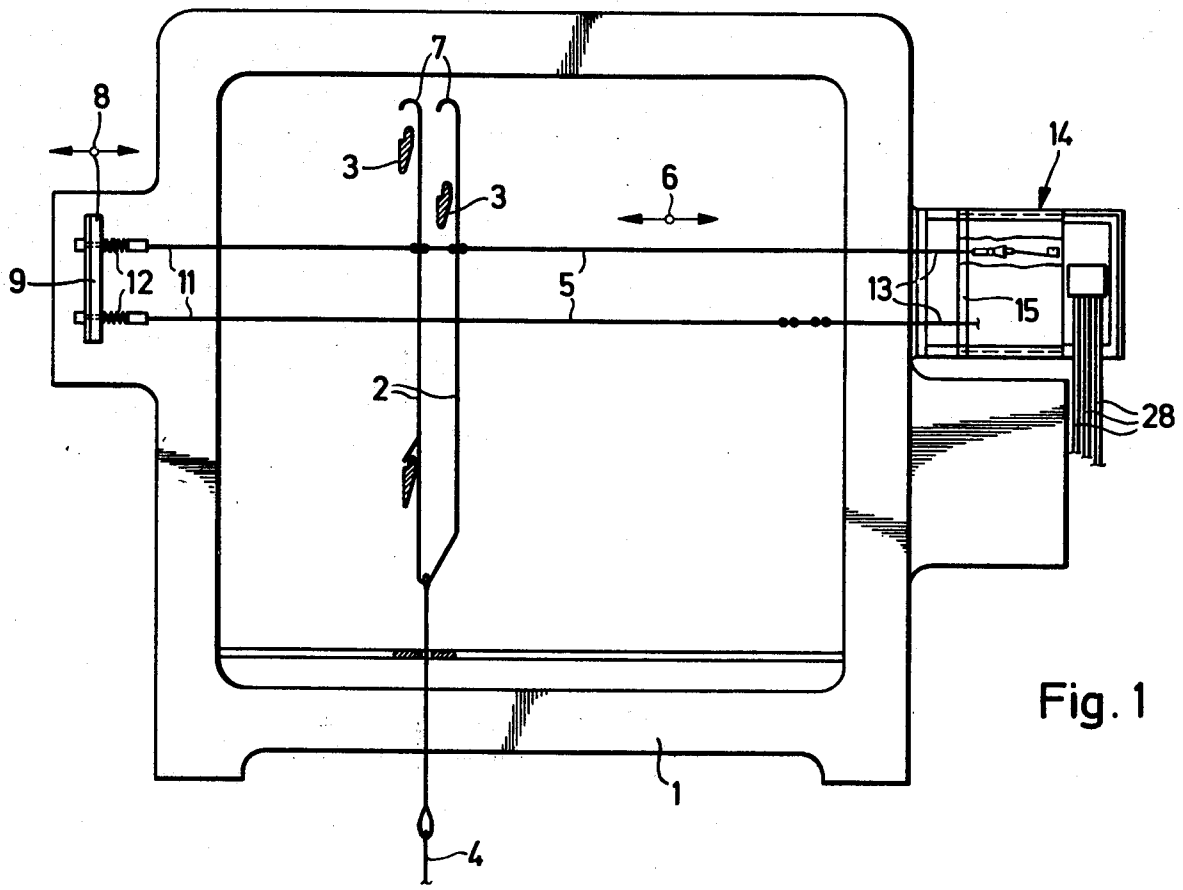
FIG. 1 illustrates a diagrammatic view in side elevation of a Jacquard machine according to the invention.

Referring to FIG. 1, the Jacquard machine has a frame 1 in which a plurality of lifting wires 2 are disposed for coupling with various lifting bars or swords 3 as is known. The lifting wires 2 are secured to warp heddles 4 of a weaving machine (not shown) below the Jacquard machine so as to control the movement of the warp yarns into top shed and bottom shed positions. The wires 2 are pressed by horizontal pressers or Jacquard needles 5 as indicated by the double arrow 6 so that hooks 7, which are on the wires 2 are, for instance, placed beyond or within the range of the lifting bars 3.

The Jacquard machine also has a presser drive at one end of the pressers 5 for moving the pressers 5 in a given direction. As indicated, the presser drive is formed by a rake 9 which reciprocates as indicated by a double arrow 8. In addition, springs 12 are provided at the left hand ends 11 of the pressers 5, as viewed, where the rake 9 strikes the pressers 5.

The Jacquard machine also has a selection system 14 at the opposite end of the pressers 5 for selectively inhibiting the movement of the pressers 5 in the direction indicated by the arrows 6 in accordance with a weave program. As indicated, the selection system 14 is located at the right hand end 13 of the pressers 5.

Figure 2:
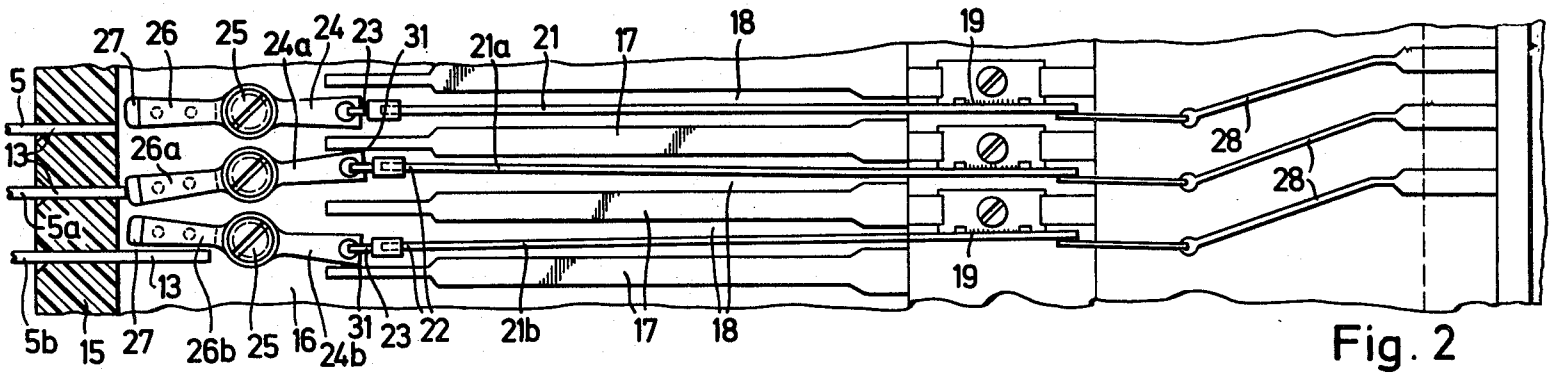
FIG. 2 illustrates a plan view of a part of the selection system according to the invention.
Figure 3:
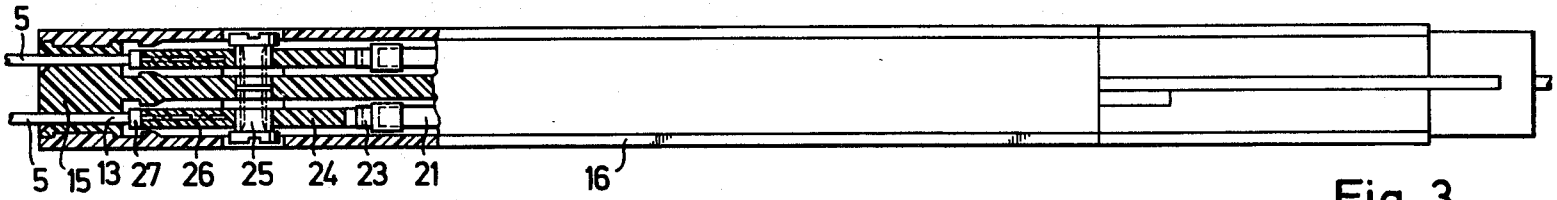
FIG. 3 illustrates a side view partly in section of the selection system of FIG. 2.

Referring to FIGS. 2 and 3, the selction system 14 has a casing provided with a vertical guide 15 which guides the presser ends 13 via suitable bores as shown. The guide 15 is formed, for example, on a plastic base plate 16 which has a large number of ribs 17 which may be integral therewith. In addition, the selection system has a plurality of control elements 21 in the form of multimorphous bending strips which are secured at one end 19 to the casing in a suitable manner. Each bending strip 21 is received in a channel 18 bounded by the ribs 17. The free ends of the strips 21 are provided with plastic caps 23 for purposes as described below.

The selection system also includes a plurality of means such as double arm metal locking levers 24, 26 which are each pivotally mounted on an axle 25 secured in the casing. As shown, one arm 24 is pivotally articulated to a plastic cap 23 on the free end of a bending strip 21 while the other arm 26 is disposed opposite to the vertical guide 15 so as to cooperate with a presser 5.

Each lever 24, 26 is disposed for pivoting movement of the arm 26 into and out of the path of a respective presser 5 in response to the movement of a respective control element 21.

Each locking lever 24, 26 is made of a plastics such as polyamide and has a hardened steel insert 27 at the end facing a presser 5.

Each control element 21 is movable into various positions. For example, during operation, each bending strip 21 is electrically energized by a supply wiring 28 in accordance with a weave program of the weaving machine so as to be deflected either in one direction (position 21*a*) or the other direction (position 21*b*) from a central position 21. Corresondingly, each lever 24, 26 is in a locking position 24*a*, 26*a*, an inoperative position 24*b*, 26*b* or in a central position 24, 26. In a similar manner, each presser 5 may move into a position 5*a* in which the associated lifting wire 2 of FIG. 1 is not being pressed to the right and therefore remains in engagement with the lifting bars 3, or each presser may move into a position 5*b* in which the lifting wires 2 are pressed and therefore disengage from the lifting bars 3. Otherwise, the pressers 5 remain in a neutral position as indicated in FIG. 2 while the rake 9 is in an inoperative position (on the left as shown in FIG. 1). The operative movement of each lever 24, 26 or of each bending strip 21 is limited by abutments 31 of the ribs 17.

The pressers 5 are disposed to strike the inserts 27 in the locking levers 24, 26 during operation when the lever is in the blocking position 24*a*, 26*a*.

During operation, when a rake 9 moves the pressers 5 towards the selection system 14, those pressers 5*a* which are blocked by the levers 24*a*, 26*a* are restrained from movement into the casing. On the other hand, those pressers 5*b* which are not blocked continue into the casing. The associated levers 24*b*, 26*b* are in the position as shown in FIG. 2, i.e. in the inoperative position.

Figure 4:
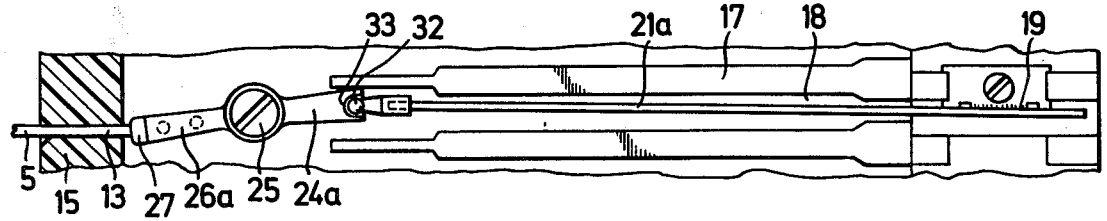
FIG. 4 illustrates a modification of a selection system in accordance with the invention.

Referring to FIG. 4, each bending strip 21 may be provided with a ball 32 mounted in a corresponding recess 33 in a locking lever 24, 26 in order to articulate the strip 21 to the lever.

Figure 5:
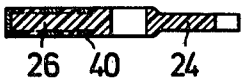
FIG. 5 illustrates a cross-sectional view of an end of a locking lever made in accordance with the invention.

Referring to FIG. 5, each lever 24, 26 may be provided with a metal covering or other hardened material at the end opposite a presser.

Figure 6:
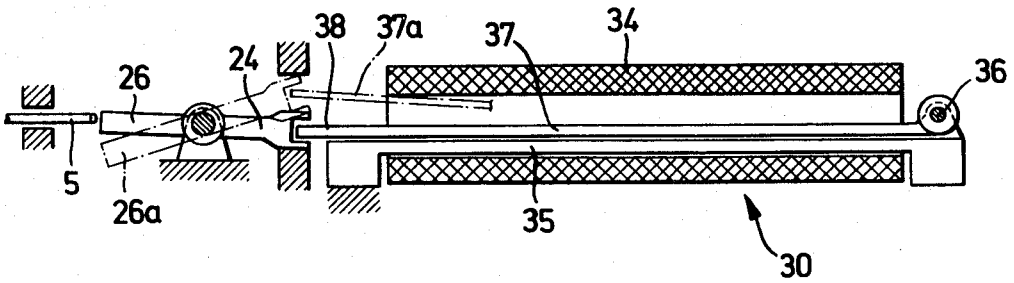
FIG. 6 illustrates a modified control element in accordance with the invention.

Referring to FIG. 6, the control element may alternatively be constructed as a switching means comprised of two electrically magnetizable relatively movable rod-like members. In this case, the switching means 30 has an electrical winding 34 in which a stationary ferromagnetic bar 35 is positioned to serve as an armature and another ferromagnetic bar 37 which is pivoted to the first bar 35 at a point 36. As shown, this latter bar 37 has an extended end 38 which projects out of the winding 34 to engage within a recess of a locking lever 24, 26. Also, the bars 35, 37 are essentially parallel to each other. Upon movement of the bar 38, the lever 24, 26 follows as indicated in FIG. 6. That is, when the winding 34 is energized, the bar 37 moves into position 37*a* since the two bars 35, 37 are magnetized in the same way and repel each other. The lever 24, 26 therefore pivots out of the locking position and into an inoperative position 26a such that the associated presser 5 can move to the right.

Figure 7:
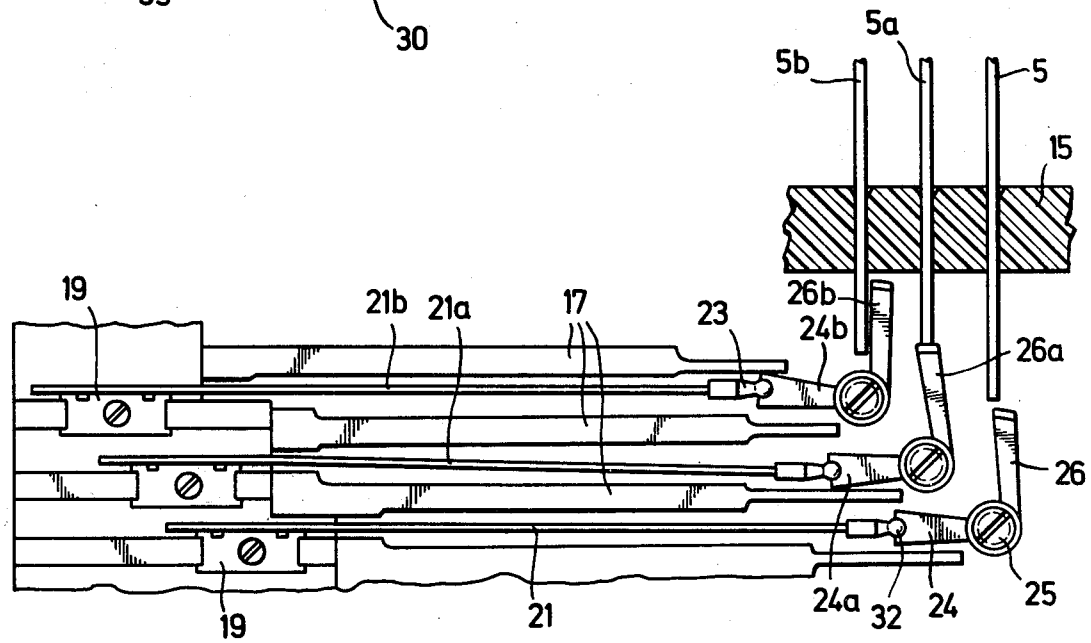
FIG. 7 illustrates a further modified selection system in accordance with the invention.

Referring to FIG. 7, the arms of the locking levers can be disposed perpendicularly relative to each other, that is, at an angle of 90°. In this case, the plane of the pressers 5 are disposed in perpendicular relationship to the plane of the control elements 21.

The locking lever can be alternatively constructed of steel. In this case, the caps 23 on the strips 21 have an insulating effect in relation to the metal levers 24, 26. This is of importance because the bending strip 21 is usually made of a ceramic conductive substance, for example an electrostrictive or magnetostrictive laminate. Such, for example, as piezeoelectric ceramic, barium titanate, lead barium titanate, lead zirconate, titanate or the like.

What is claimed is:

1. A Jacquard machine comprising a plurality of pressers for programmming a plurality of lifting wires controlling warp yarns of a weaving machine;

a presser drive including a spring on each respective presser for moving said pressers in a given direction against said springs; and a selection system for selectively inhibiting the movement of said pressers in said direction in accordance with a weave program, said selection system including a plurality of control elements movable between at least two positions and a plurality of locking levers, each said lever being disposed for movement into and out of the path of a respective presser in response to movement of said respective control element.

2. A Jacquard machine as set forth in claim 1 wherein each control element has a free end pivoted to one arm of a respective locking lever.

3. A Jacquard machine as set forth in claim 1 wherein each said locking lever is made of plastics and has an end opposite a presser made of a hardened material.

4. A Jacquard machine as set forth in claim 1 wherein each said control element has a plastics cap on a free end thereof connected to a respective lever.

5. A Jacquard machine as set forth in claim 1 wherein each said control element is a multimorphous bending strip.

6. A Jacquard machine as set forth in claim 1 wherein each said control element is a switching means comprising two electrically magnetizable relatively movable rod-like members disposed in essentially parallel relation.

7. A Jacquard machine as set forth in claim 1 wherein each locking lever has two arms, one of said arms being disposed near a respective control element and a second of said arms being disposed near a respective presser.

8. A Jacquard machine as set forth in claim 1 wherein each locking lever is pivotally mounted on an axle disposed in the path of a respective presser.

9. A Jacquard machine as set forth in claim 1 wherein each locking lever is disposed between a respective presser and a respective control element.

10. A Jacquard machine as set forth in claim 1 wherein said pressers are disposed in a plane perpendicular to said control elements and said levers each have two arms disposed in perpendicular relation.

11. A Jacquard machine as set forth in claim 1 which further comprises an abutment for limiting an operative movement of a respective locking lever.

12. A Jacquard machine as set forth in claim 1 which further comprises a plurality of stationary ribs defining channels receiving said control elements therein, each said pair of adjacent ribs defining abutments to limit the operative movement of a respective locking lever.

13. In a Jacquard selection system, the combination comprising a casing;

a control element disposed in said casing and having a free end movable between at least two positions;

a presser movably mounted relative to said casing for moving into one of a sensing position and a non-sensing position relative to said control element; and a locking lever pivotally mounted in said casing for moving with said control element to selectively inhibit movement of said presser into said nonsensing position, said lever being disposed in said casing to transfer the force of said presser into said casing with said presser in said sensing position without stressing of said control element.

14. The combination as set forth in claim 13 wherein said locking lever is made of plastics and has an end opposite said presser made of a hardened material.

15. The combination as set forth in claim 13 wherein said control element is a multimorphous bending strip.

16. The combination as set forth in claim 13 wherein said control element is a switching means comprising two electrically magnetizable relatively movable rod-like members.

* * * * *